US011840098B2

(12) United States Patent
Burke et al.

(10) Patent No.: US 11,840,098 B2
(45) Date of Patent: Dec. 12, 2023

(54) SPIT FLAP FOR INKJET PRINTHEAD

(71) Applicant: Memjet Technology Limited, Dublin (IE)

(72) Inventors: David Burke, North Ryde (AU); Jason Mark Thelander, North Ryde NSW (AU); Dan Baterna, North Ryde (AU); Rommel Balala, North Ryde Nsw (AU); Peter Crichton, North Ryde (AU)

(73) Assignee: Memjet Technology Limited, Dublin (IE)

( * ) Notice: Subject to any disclaimer, the term of this patent is extended or adjusted under 35 U.S.C. 154(b) by 17 days.

(21) Appl. No.: 17/745,626

(22) Filed: May 16, 2022

(65) Prior Publication Data

US 2022/0363062 A1 Nov. 17, 2022

Related U.S. Application Data

(60) Provisional application No. 63/189,413, filed on May 17, 2021.

(51) Int. Cl.
*B41J 25/304* (2006.01)
*B41J 2/165* (2006.01)

(52) U.S. Cl.
CPC ..... *B41J 25/304* (2013.01); *B41J 2/16505* (2013.01); *B41J 2/16508* (2013.01); *B41J 2/16511* (2013.01); *B41J 2/16544* (2013.01); *B41J 2/16535* (2013.01); *B41J 2002/16514* (2013.01)

(58) Field of Classification Search
CPC .. B41J 25/304; B41J 2/16505; B41J 2/16508; B41J 2/16511; B41J 2/16544; B41J 2/16535; B41J 2002/16514
See application file for complete search history.

(56) References Cited

U.S. PATENT DOCUMENTS 5,548,309 A * 8/1996 Okubo ..... B41J 2/16508 347/33
8,523,344 B2 * 9/2013 Mitsunaga ..... B41J 11/006 347/101
2009/0141073 A1 * 6/2009 Umeda ..... B41J 2/16511 347/30

* cited by examiner

*Primary Examiner* — Geoffrey S Mruk
(74) *Attorney, Agent, or Firm* — Cooley LLP

(57) ABSTRACT

A printing device includes: an inkjet printhead; a lift mechanism for raising and lowering the printhead through a lift path; and a pivotally movable spit flap positioned in the lift path. The spit flap is configured to swing away from the lift path when the printhead contacts the spit flap during lowering of the printhead.

13 Claims, 2 Drawing Sheets

SPIT FLAP FOR INKJET PRINTHEAD

CROSS REFERENCE TO RELATED APPLICATIONS

This application claims priority to and the benefit of U.S. Provisional Patent Application No. 63/189,413, entitled SPIT FLAP FOR INKJET PRINTHEAD, filed on May 17, 2021, the disclosure of which is incorporated herein by reference in its entirety for all purposes.

FIELD OF THE INVENTION

This invention relates to a spittoon system for an inkjet printhead. It has been developed primarily for transitioning from a maintenance mode to a printing mode with minimal loss of nozzle health prior to printing.

BACKGROUND OF THE INVENTION

The Applicant has developed a range of Memjet® inkjet printers as described in, for example, WO2011/143700, WO2011/143699 and WO2009/089567, the contents of which are herein incorporated by reference. Memjet® printers employ a stationary printhead in combination with a feed mechanism which feeds print media past the printhead in a single pass. Memjet® printers therefore provide much higher printing speeds than conventional scanning inkjet printers.

Inkjet printheads are prone to a phenomenon known in the art as 'decap'. Decap is a term used to describe the buildup of viscous ink components within nozzles during non-printing periods. If nozzles are not capped and do not eject ink for a certain period, then a viscous plug usually forms in the nozzles, which may inhibit or prevent ejection of ink. Non-ejecting nozzles are usually recoverable via a maintenance intervention (e.g. pressurized ink purging, applied suction etc.). Additionally, various measures may be employed in inkjet printers to address the problem of decap without resorting to a maintenance intervention. For example, nozzles may receive a warming pulse of energy between ejections to reduce the viscosity of ink in the nozzles. Furthermore, inkjet printers are typically equipped with a spittoon, which allows the printhead to eject ink from nozzles before a print job and/or between pages in the case of sheet-fed printers. For example, U.S. Pat. Nos. 1,067,589, and 10,675,872 describe spittoons positioned below a media feed path for receiving spitted ink.

During a maintenance cycle of a printhead, the printhead is typically wiped and all nozzles are primed for printing, either via application of suction to the nozzle face or positively pressurizing ink supplied to the printhead so as to purge ink from the nozzles. However, even with all nozzles primed for printing, the printhead typically must be repositioned from a maintenance position to a printing position and the media supply mechanism started before the printhead is used for actual printing onto media. This delay between nozzle priming and printing may be several seconds, which may be comparable to the decap time of inkjet nozzles for certain inks. It would therefore be desirable to provide a means for transitioning from a maintenance mode to a printing mode with minimal loss of nozzle health prior to printing.

SUMMARY OF THE INVENTION

In a first aspect, there is provided a printing device comprising:

an inkjet printhead;

a lift mechanism for raising and lowering the printhead through a lift path; and a pivotally movable spit flap positioned in the lift path, wherein the spit flap is configured to swing away from the lift path when the printhead contacts the spit flap during lowering of the printhead.

The printing device according to the first aspect advantageously enables printheads to transition from a maintenance mode to a printing mode with minimal loss of nozzle health.

Preferably, the spit flap is configured for receiving ink spitted from the printhead.

Preferably, the spit flap is mounted to a first end of a swing arm and an opposite second end of the swing arm is pivotally mounted about a fixed pivot rod.

Preferably, the spit flap is resiliently flexible.

Preferably, a lower edge region of the printhead is configured for camming engagement with the spit flap.

Preferably, the lower edge region has a scraping edge for scraping ink from the spit flap.

Preferably, the lower edge region is configured to retain ink scraped from the spit flap.

Preferably, the lower edge region has a non-absorbent hydrophilic surface for retaining ink.

Preferably, the lower edge region has a concavely curved portion for receiving ink from the scraping edge and retaining ink therein.

Preferably, the printing device further comprises a wiper for wiping a nozzle face of the printhead and the lower edge region.

Preferably, the wiper is configured for wiping longitudinally along a length of the printhead.

Preferably, the printing device further comprises a capper for capping the printhead, wherein the capper is moveable towards and away from the printhead in a direction parallel to the media feed direction.

Preferably, the capper is positioned at an opposite side of the printhead relative to the swing arm.

In a second aspect, there is provided a method of transitioning from a maintenance position of a printhead to a printing position of the printhead, said method comprising the steps of:

lowering a printhead from a maintenance position, through a lift path, towards a media feed path;

spitting ink onto a pivotally moveable spit flap positioned in the lift path;

abutting the printhead with the spit flap, thereby causing the spit flap to swing away from the lift path; and positioning the printhead in the printing position at a predetermined height above the media feed path.

As used herein, the term "ink" refers to any printable fluid, including conventional dye-based and pigment-based inks, infrared inks, UV curable inks, 3D printing fluids, biological fluids, colorless ink vehicles etc.

As used herein, the term "mounted" includes both direct mounting and indirect mounting via an intervening part.

BRIEF DESCRIPTION OF THE DRAWINGS

Embodiments of the present invention will now be described by way of example only with reference to the accompanying drawings, in which.

DETAILED DESCRIPTION OF AN EMBODIMENT OF THE INVENTION

Figure 1:
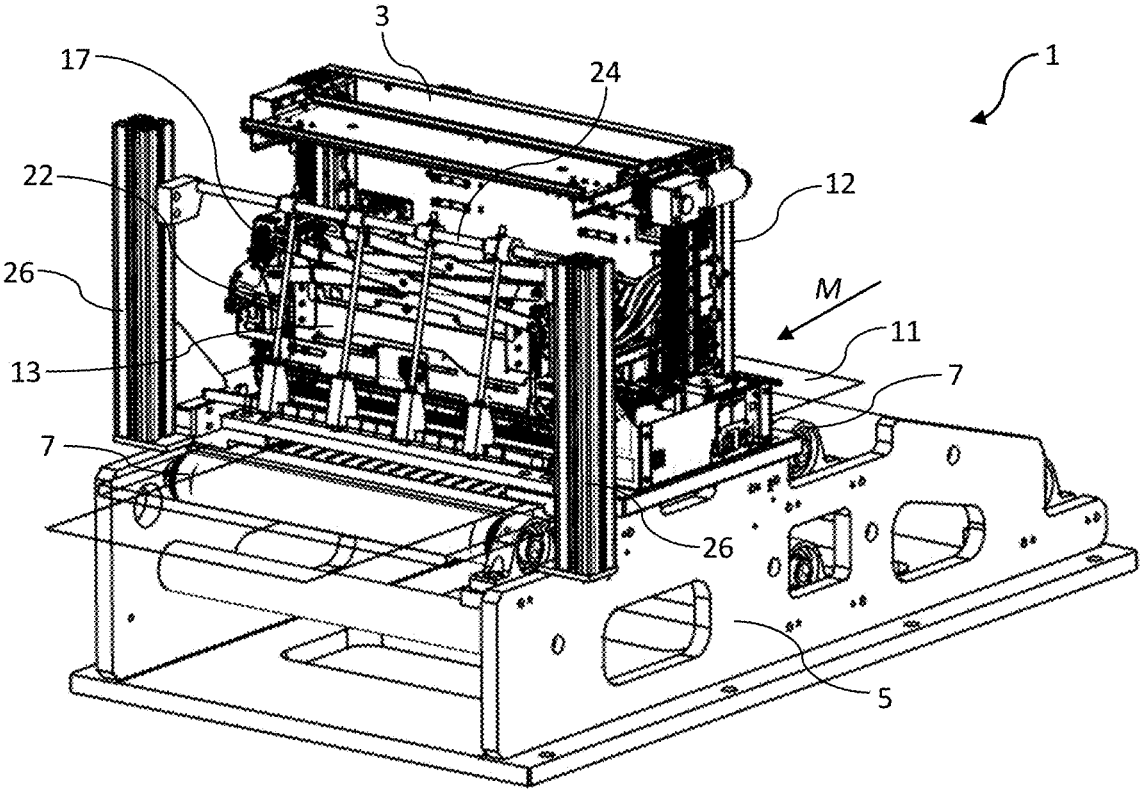
FIG. 1 is a perspective view of a printing device having a spit flap.
Figure 2:
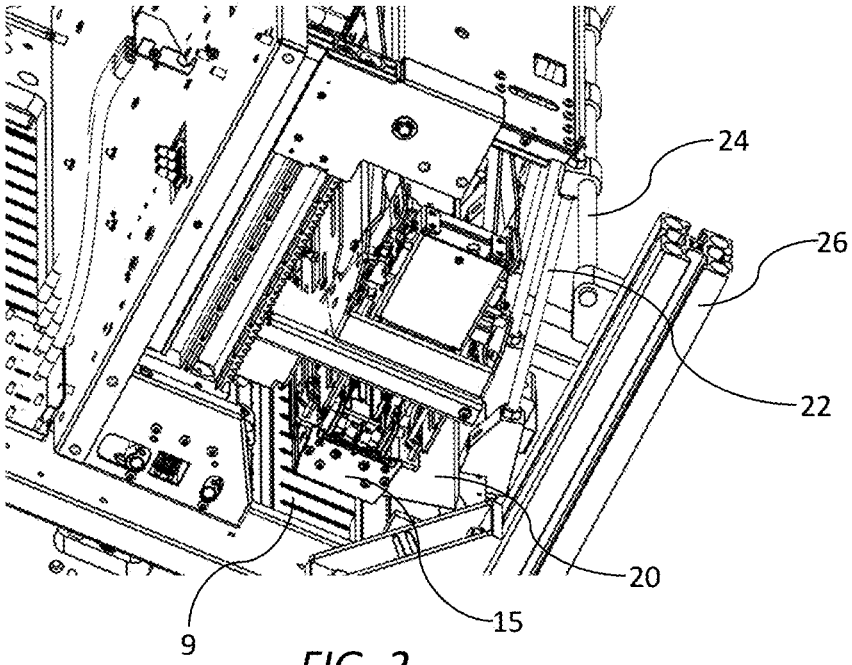
FIG. 2 is a magnified rear perspective of the printing device shown in FIG. 1.

Referring to FIGS. 1 and 2, there is shown a printing device 1 according to one aspect of the present invention. The printing device 1 comprises a print engine 3 fixedly mounted on a media feed chassis 5. The media feed chassis 5 comprises various rollers 7 and a platen 9 (e.g. vacuum platen) for guiding print media 11 along a media feed path M. The print engine 3 is substantially as described in U.S. Pat. No. 10,967,638 (the contents of which are incorporated herein by reference) and comprises a print chassis 12 fast with the media feed chassis 5, a print module 13 containing a replaceable pagewide inkjet printhead 15 and a lift mechanism 17 for lifting and lowering the printhead through a lift path relative to the media feed path M (the lift path being perpendicular to the media feed path). As described in U.S. Pat. No. 10,967,638, the print engine 3 further comprises capping and wiping systems for maintaining the printhead 15 when the printhead raised from its printing position.

As best shown in FIGS. 3A-3D, a pivotable spit flap 20 is positioned in the lift path L between a raised (maintenance) position of the printhead 15 and a lowered (printing) position of the printhead. The spit flap 20 is supported by one or more swing arms 22 pivotally mounted about a fixed pivot rod 24. The pivot rod 24 defines a pivot axis perpendicular to the media feed path M (and the lift path L) at a height above the spit flap 20. As shown in FIG. 1, the pivot rod 24 extends across the media feed path M and is supported between a pair of stanchions 26 extending upwardly from opposite sides of the media feed chassis 5. In other embodiments, the pivot rod 24 may be supported by part of the print engine 3.

Figure 3A:
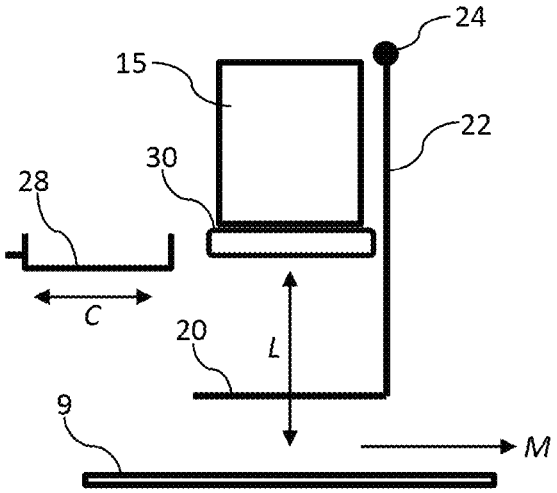
FIGS. 3A-D are schematic end views of a printhead being lowered into a printing position.

Referring again to FIG. 3A, with the printhead 15 in its raised position, capping and wiping operations may be performed on the printhead, as described in U.S. Pat. Nos. 10,967,638 and 10,076,917 (the contents of which are incorporated herein by reference). Capping may be performed by laterally moving a capper 28 along a direction C (i.e. parallel with the media feed direction M) into alignment with the printhead 15 and then gently lowering the printhead onto the capper. With the capper 28 retracted and parked to one side of the printhead 15, as shown in FIG. 3A, the printhead may be wiped by moving a wiper 30 longitudinally along a length of the printhead (i.e. into the page as shown in FIG. 3A). The wiper 30 may be parked at one end of the printhead 15 when not in use, as described in U.S. Pat. No. 10,967,638.

Figure 3B:
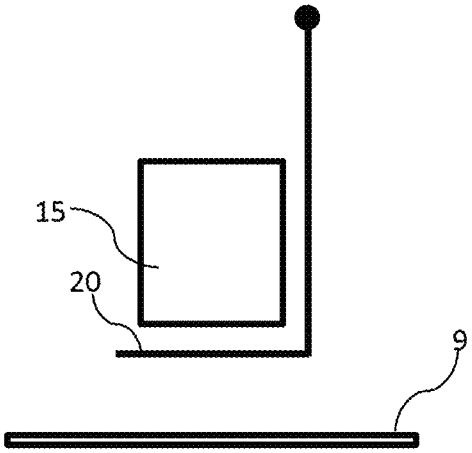
Figure 3C:
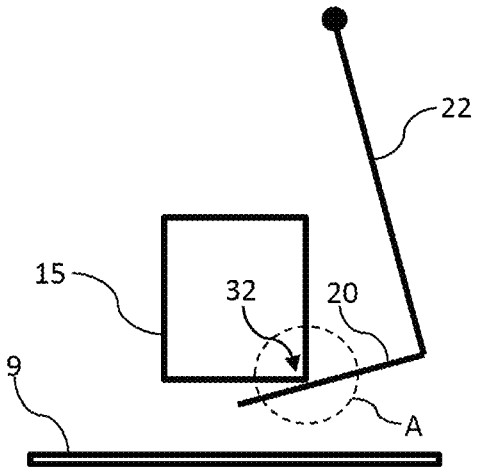
Figure 3D:
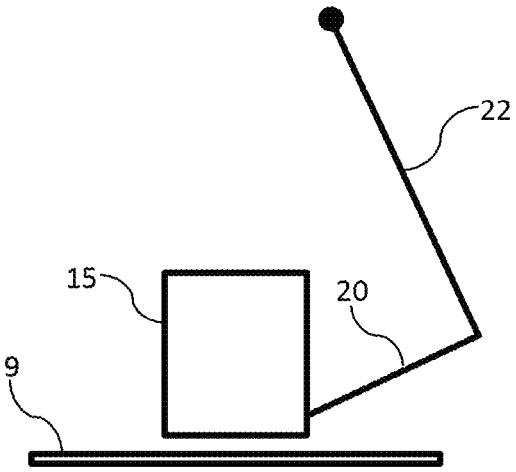

FIG. 3B shows the printhead 15 being lowered through the lift path L after a wiping operation. (In the interests of clarity, the parked capper 28 and wiper 30 are not shown in FIGS. 3B-D). Initially, the printhead 15 is lowered towards the spit flap 20, whereupon ink may be spitted from printhead nozzles onto an upper ink-receiving surface of the spit flap, as shown in FIG. 3B. The printhead 15 then continues its traverse downwards along the lift path L and abuts with the spit flap 20, as shown in FIG. 3C. Camming engagement between a lower edge region of the printhead 15 and the spit flap 20 causes the swing arm(s) 24 to pivot and swing the spit flap away from and out of alignment with the lift path L, thereby allowing the printhead to continue its downward traverse towards the platen 9. Finally, as shown in FIG. 3D, the printhead 15 arrives at its lowered (printing) position at a predetermined height above the platen 9 ready for printing. Here, the spit flap 20 is pivoted fully away from the lift path L and, in some embodiments, may be latched in this position at least for the duration of printing.

From the foregoing, it will be appreciated that the spit flap 20 positioned in the lift path L assists in keeping all nozzles of the printhead 15 hydrated and ready for printing by minimizing a time period between printhead wiping and a first post-wiping ink ejection from the printhead nozzles. If necessary, the printhead 15 may be paused momentarily at the position shown in FIG. 3B with intermittent spitting onto the spit flap 20 until the printing device 1 is fully ready for printing.

Typically, the spit flap 20 is comprised of a non-absorbent material (e.g. stainless steel, polymer etc) having a degree of flex to allow the spit flap to swing away from the lift path L upon engagement with the printhead 15. In practice, only relatively small quantities of ink are received by the spit flap 20, which can be readily removed therefrom.

Figure 4:
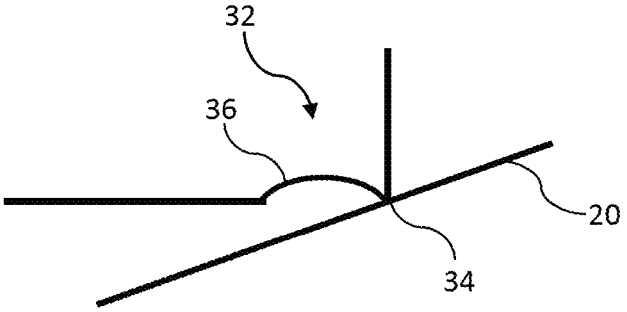
FIG. 4 is a magnified schematic view of the dashed circular region A shown in FIG. 3B.

Referring to the magnified view in FIG. 4, the lower edge region 32 of the printhead 15 makes contact with the spit flap 20, which causes the spit flap to pivot away from the lift path L. The spit flap 20 is typically comprised of a low-friction material (e.g. polymer), which allows it to slip past a contact surface in the form of a scraping edge 34. The scraping edge 34 slidingly contacts the spit flap 20 and scrapes spitted ink received on the spit flap towards a concave ink retention zone 36 of the edge region 32. The ink retention zone 36 collects ink from the scraping edge 34 and retains the collected ink via surface tension. Transfer of ink from the spit flap 20 to the edge region 32 may be facilitated by providing a relatively hydrophobic upper surface of the spit flap and a relatively hydrophilic lower surface of the edge region 32. A hydrophilic surface of the ink retention zone 36 further assists in retaining ink therein. The ink retained in the ink retention zone 36 may be removed during subsequent wiping of the printhead 15 using the wiper 30.

It will, of course, be appreciated that the present invention has been described by way of example only and that modifications of detail may be made within the scope of the invention, which is defined in the accompanying claims.

The invention claimed is:

1. A printing device comprising:
an inkjet printhead;
a lift mechanism for raising and lowering the printhead through a lift path; and
a pivotally movable spit flap positioned in the lift path, wherein the spit flap is configured to swing away from the lift path when the printhead contacts the spit flap during lowering of the printhead.

2. The printing device of claim 1, wherein the spit flap is configured for receiving ink spitted from the printhead.

3. The printing device of claim 1, wherein the spit flap is mounted to a first end of a swing arm and an opposite second end of the swing arm is pivotally mounted about a fixed pivot rod.

4. The printing device of claim 3, further comprising a capper for capping the printhead, wherein the capper is moveable towards and away from the printhead in a direction parallel to the media feed direction.

5. The printing device of claim 4, wherein the capper is positioned at an opposite side of the printhead relative to the swing arm.

6. The printing device of claim 1, wherein the spit flap is resiliently flexible.

7. The printing device of claim 1, wherein a lower edge region of the printhead is configured for camming engagement with the spit flap.

8. The printing device of claim 7, wherein the lower edge region has a scraping edge for scraping ink from the spit flap.

9. The printing device of claim 8, wherein the lower edge region is configured to retain ink scraped from the spit flap.

10. The printing device of claim 9, wherein the lower edge region has a non-absorbent hydrophilic surface for retaining ink.

11. The printing device of claim 9, wherein the lower edge region has a concavely curved portion for receiving ink from the scraping edge and retaining ink therein.

12. The printing device of claim 7, further comprising a wiper for wiping a nozzle face of the printhead and the lower edge region.

13. The printing device of claim 12, wherein the wiper is configured for wiping longitudinally along a length of the printhead.

* * * * *